US006857941B2

(12) United States Patent
Emami et al.

(10) Patent No.: US 6,857,941 B2
(45) Date of Patent: Feb. 22, 2005

(54) MULTI-PHASE POLISHING PAD

(75) Inventors: Ramin Emami, San Jose, CA (US); Robert Lum, Sunnyvale, CA (US); Sourabh Mishra, Campbell, CA (US)

(73) Assignee: Applied Materials, Inc., Santa Clara, CA (US)

( * ) Notice: Subject to any disclaimer, the term of this patent is extended or adjusted under 35 U.S.C. 154(b) by 98 days.

(21) Appl. No.: 10/139,112

(22) Filed: May 2, 2002

(65) Prior Publication Data

US 2002/0197946 A1 Dec. 26, 2002

Related U.S. Application Data

(60) Provisional application No. 60/295,274, filed on Jun. 1, 2001.

(51) Int. Cl.[7] ..... B24B 1/00

(52) U.S. Cl. ..... 451/41; 451/59; 451/285; 451/289; 451/288; 451/527; 451/528

(58) Field of Search ..... 451/41, 57, 285, 451/289, 288, 527, 528

(56) References Cited

U.S. PATENT DOCUMENTS

| | | | | | |
|---|---|---|---|---|---|
| 3,841,031 | A | | 10/1974 | Walsh | 51/283 |
| 5,738,574 | A | | 4/1998 | Tolles et al. | 451/288 |
| 5,769,699 | A | * | 6/1998 | Yu | 451/528 |
| 5,899,745 | A | * | 5/1999 | Kim et al. | 438/692 |
| 5,944,583 | A | | 8/1999 | Cruz et al. | 451/41 |
| 5,951,380 | A | | 9/1999 | Kim | 451/65 |
| 5,985,090 | A | | 11/1999 | Kikuta et al. | 156/345 |
| 6,093,085 | A | | 7/2000 | Yellitz et al. | 451/41 |
| 6,106,661 | A | | 8/2000 | Raeder et al. | 156/345 |
| 6,168,508 | B1 | | 1/2001 | Nagahara et al. | 451/527 |
| 6,197,692 | B1 | | 3/2001 | Fushimi | 438/692 |
| 2002/0045409 | A1 | | 4/2002 | Carlson et al. | 451/54 |

* cited by examiner

*Primary Examiner*—Joseph J. Hail, III
*Assistant Examiner*—Alvin J Grant
(74) *Attorney, Agent, or Firm*—Moser, Patterson & Sheridan

(57) ABSTRACT

An article of manufacture, a method, and an apparatus for use in a chemical mechanical polishing system is provided. In one aspect, an article of manufacture is provided for polishing a substrate including a polishing article having a polishing surface, the polishing surface including a first polishing portion having a first polishing material of a first hardness for polishing a first portion of the substrate, and a second polishing portion having a second polishing material of a second hardness for polishing a second portion of the substrate. The article of manufacture may be disposed on a rotatable, stationary, or linear platen for processing a substrate. In another aspect, a method is provided for processing a substrate, including providing a platen containing the polishing article disposed on the rotatable platen, delivering a polishing composition to the polishing article, and contacting a substrate on the polishing article.

6 Claims, 5 Drawing Sheets

MULTI-PHASE POLISHING PAD

CROSS-REFERENCE TO RELATED APPLICATIONS

This application claims benefit of U.S. Provisional Patent Application Ser. No. 60/295,274, filed Jun. 1, 2001, which is incorporated herein by reference.

BACKGROUND OF THE INVENTION

1. Field of the Invention

The present invention relates to an apparatus for polishing substrates. More particularly, the invention relates to a platen/polishing pad assembly having a compliant surface to improve polishing uniformity of substrates.

2. Background of the Related Art

In the fabrication of integrated circuits and other electronic devices, multiple layers of conducting, semiconducting and dielectric materials are deposited and removed from a substrate during the fabrication process. Often it is necessary to polish a surface of a substrate to improve substrate surface uniformity by removing high topography, surface defects, scratches or embedded particles as well as improve polishing consistency from one substrate to the next to form substrates with consistent substrate surfaces for subsequent polishing. One common polishing process is known as chemical mechanical polishing (CMP) and is used to improve the quality and reliability of the electronic devices formed on the substrate.

Typically, the polishing process involves the introduction of a chemical slurry during the polishing process to facilitate chemical reaction with material components of the substrate surface to provide for higher removal of material components therefrom. In general, the polishing process involves holding a substrate against a polishing pad under controlled pressure, temperature and relative speed (velocity) of the pad in the presence of the slurry or other fluid medium. One polishing system that is used to perform CMP is the Mirra® CMP System available from Applied Materials, Inc., and shown and described in U.S. Pat. No. 5,738,574, entitled, "Continuous Processing System for Chemical Mechanical Polishing," the entirety of which is incorporated herein by reference.

An important goal of CMP is achieving uniform substrate and die (substrate to substrate) planarity of substrate surfaces. Uniform planarity includes the uniform removal of material from across the surface of substrates as well as removing topographical defects and layer variations that have been deposited on the substrate. Further, uniformity must be achieved not only for a single substrate, but also for a series of substrates processed in a batch for consistent substrate to substrate processing.

One factor that can detrimentally affect polishing uniformity of substrates during sequential substrate polishing is cross-contamination. One source of cross-contamination are particles on the polishing pad that may be generated from polishing processes performed in the polishing system. Particles in the polishing system can originate from materials 10, such as tungsten and copper, deposited on the edge area 40 of a substrate 1 as shown in FIG. 1. For example, one source of particles in the polishing system can arise from material 10 deposited on the beveled edge 20 of a substrate 1, which can flake or peel off during chemical mechanical polishing.

Another potential problem is the excess amount of material that may be deposited on an edge bead removal (EBR) area 30 of the substrate. The excess material may be dislodged as particles from the substrate during polishing to form a source of cross-contamination. Excess materials dislodged from the EBR area 30 may be dislodged by a tearing phenomena and remove material from adjacent portions of the substrate or devices formed on the substrate. Additionally, the material deposited on the beveled edge 20 and the EBR area 30 is usually of a different level as the material deposited on the rest of the substrate surface, which may not be sufficiently planarized with the rest of the substrate surface when polished and result in a non-uniform surface.

Currently, polishing processes remove tungsten using a "hard" or "soft" polishing pad. Hard polishing pads, or rigid polishing pads, have a higher removal rate of material and longer processing life than soft pads, but hard polishing pads 50 generally have difficulty removing material from the bevel edge 20 of a substrate 1 as shown in FIG. 2. Examples of hard polishing pads are the IC-1000 and IC-1010 polishing pads commercially available from Rodel Inc. of Phoenix Ariz. (IC-1000 is a product name of Rodel, Inc.)

Soft polishing pads, or compliant polishing pads, have the ability to flex to low bevel areas 20 and remove deposited materials from the edge area 40 of the substrate, but often have a lower removal rate, decreased uniform polishing, and a shorter processing life than hard polishing pads due to their weaker mechanical properties. Additionally, soft polishing pads 60 may overpolish materials 70 in a substrate feature to form a topographical defect referred to as dishing as shown in FIG. 3. An example of a soft polishing pad is the Politex or Suba IV commercially available from Rodel Inc. of Phoenix, Ariz. (Politex and Suba IV are product names of Rodel, Inc.) The non-planar nature of dishing can detrimentally affect subsequent processing of the substrate surface.

One proposed solution to remove material from the bevel edge 20 and EBR area 30 is to first polish the substrate with a hard pad to remove the majority of conductive material from the substrate surface and then polishing the substrate with a softer pad to buff the substrate remove remaining conductive material from the bevel edge 20 and any necessary dielectric material. Buffing involves polishing the substrate on a platen with a low application of force between the substrate surface and the polishing pad and generally using a polishing composition with a low material removal rate compared to conventional polishing processes.

However, the use of two separate pads for bevel edge 20 and EBR area 30 removal increases the number of processing steps and processing time, decreases substrate throughput, increases operating costs, and increases equipment usage. Additionally, the hard pad may still dislodge the excess deposition at the edge area 40 of the substrate that can damage adjacent portions of the substrate prior to polishing with the soft pad, and the soft polishing pad may still result in dishing or overpolishing of the substrate features.

Another solution to remove material from the bevel edge 20 and EBR area 30 is to use a stack of polishing pads, or a composite pad, such as a hard polishing pad disposed on a soft polishing pad. The combination of pads having the proper proportions of hardness and compliance, or flexibility, is believed to achieve good planarity and uniformity over the surface of the substrate as well as improve polish of the edge area of the substrate.

However, a number of problems are associated with composite pads. One problem with composite pads is the interdependence of the individual pads upon one another. For example, a pressure exerted on the upper pad is transmitted to the lower pad. Because the upper pad is generally a rigid material having limited compressibility, applied pressure is accommodated by deformation of the upper material, or more often, by displacement of the position of the upper pad. The displacement of the upper material results in pressure being applied to the lower pad. The pressure on the lower pad is partially absorbed by compression of the lower pad and can result in deformation of the lower pad.

In the case of a shearing force, such deformation can result in ripples or waves on the lower pad due to the mass compression and redistribution of the lower pad which, during operation, exert a resultant force on the upper pad which can result in non-uniform polishing and undermine the goal of substrate planarization. Efforts to prevent pressure deflection and improve planarity by the use of lower pads made of composite materials have been less than successful in preventing pressure deflection and are not sufficiently effective in removing material from the bevel edge 20 and EBR area 30 of the substrate.

Additionally, since the upper pad of a composite pad includes a polishing surface of a uniform hardness and an underlying layer of softer material to establish a desired flexibility of the composite pad, the flexibility of the lower pad rarely translates into flexibility of the upper surface in relationship to polishing substrate surfaces that are not planar to the polishing pad. For example, the upper pad may still lack the require flexibility of the lower pad to remove substrate materials from the bevel edge 20 of a substrate 1 as shown in FIG. 2.

Another problem with composite pads is that each additional layer, e.g., pad and adhesive layer, in the composite pad acts as a source of variation affecting the overall stiffness, compression and/or compliance of the composite pad. The greater the number of layers or even variations in the thickness of pads, the greater the potential for variation. As a result, a polishing device utilizing a composite pad is often unable to achieve desired polishing results over a number of substrates. In addition, the planarity may change as the upper pad wears away by a process known as conditioning the pad. As the upper pad is reduced in thickness, the planarity may decrease with increasing numbers of substrates polished on the pad.

One solution to the difficulty of composite pads of multiple layers is to polish substrates with a single layer pad having both hard and soft materials. One example of such pads are polishing pads having concentric rings of polishing materials with the ring being composed of materials having different hardness. For example, in U.S. Pat. No. 5,944,583, ('583), a polishing pad is disclosed having alternating concentric rings of hard and soft materials. However, the '583 case uses the rings of polishing materials to provide consistent and uniform coverage of polishing slurry across the substrate surface during polishing and does not disclose polishing of excess material from the from the bevel edge 20 of a substrate 1 as shown in FIG. 2. Additionally, the '583 polishing pad requires polishing the substrate surface on the multiple polishing areas, which are substantially less than the diameter of the wafer, and does not disclose selective polishing of portions of a substrate surface, such as the bevel edge of a substrate.

U.S. Pat. No. 6,168,508 discloses a polishing pad multiple polishing areas having different properties, such as hardness, for polishing a substrate to derive the benefits from polishing with both hard and soft materials. However, the polishing pad is designed for polishing a substantial portion of the substrate surface on the multiple polishing areas, which are substantially less than the diameter of the wafer. Additionally, the multiple polishing areas do not provide adequate or selective edge polishing and removal of excess material from the from the bevel edge 20 of a substrate surface.

Therefore, there is a need for an article of manufacture, process, and apparatus for polishing the edge of a substrate.

SUMMARY OF THE INVENTION

Aspects described herein generally provide an article of manufacture, an apparatus, and a method for polishing a substrate adapted for incorporation into a chemical mechanical polishing system. In one aspect, an article of manufacture is provided for polishing a substrate including a polishing article having a polishing surface, the polishing surface including a first polishing portion having a first polishing material of a first hardness for polishing a center portion of the substrate and a second polishing portion having a second polishing material of a second hardness for polishing an outer portion of the substrate, wherein the first hardness is greater than the second hardness. The second polishing portion may comprise a center portion, an outer portion, or a combination thereof, of the article of manufacture.

In another aspect, an apparatus is provided for processing a substrate including a rotatable, stationary, or linear platen and a polishing article having a polishing surface, the polishing surface including a first polishing portion having a first polishing material of a first hardness for polishing a center portion of the substrate and a second polishing portion having a second polishing material of a second hardness for polishing an outer portion of the substrate, wherein the first hardness is greater than the second hardness.

In another aspect, a method is provided for processing a substrate including providing a rotatable platen and a polishing article disposed thereon, the polishing article having a polishing surface including a first polishing portion having a first polishing material of a first hardness for polishing a center portion of the substrate and a second polishing portion having a second polishing material of a second hardness for polishing an outer portion of the substrate, wherein the first hardness is greater than the second hardness, delivering a polishing composition to the polishing article, and contacting a substrate on the polishing article, the first portion of the substrate contacting the first polishing material and the second portion of the substrate contacting the second polishing material.

In another aspect, an article of manufacture is provided for polishing a substrate including a polishing article having a polishing surface, the polishing surface comprising a substrate polishing area comprising a first polishing material of a first hardness, the substrate polishing area having a width greater than the diameter of a substrate, and a substrate edge polishing area comprising a second polishing material of a second hardness less than the first hardness disposed adjacent the substrate polishing area, wherein an edge of the substrate contacts the substrate edge polishing area during movement of a substrate in the substrate polishing area during a polishing process.

In another aspect, a method is provided for processing a substrate including providing a substrate to a rotatable platen having polishing article disposed thereon, the polishing article having a polishing surface comprising a substrate polishing area comprising a first polishing material of a first hardness, the substrate polishing area having a width greater than the diameter of a substrate and a substrate edge polishing area comprising a second polishing material of a second hardness less than the first hardness disposed adjacent the substrate polishing area, delivering a polishing composition to the polishing article, contacting the substrate and the polishing article, providing a relative motion between the substrate and the polishing article in the substrate polishing area to contact an edge portion of the substrate with the substrate edge polishing area, and removing material disposed on the edge portion of the substrate.

In another aspect, an apparatus is provided for processing a substrate, including a rotatable, stationary, or linear platen and a polishing article having a polishing surface, the polishing surface including a substrate polishing area comprising a first polishing material of a first hardness, the substrate polishing area having a width greater than the diameter of a substrate and a substrate edge polishing area comprising a second polishing material of a second hardness less than the first hardness disposed adjacent the substrate polishing area, wherein an edge of the substrate contacts the substrate edge polishing area during movement of a substrate in the substrate polishing area during a polishing process.

BRIEF DESCRIPTION OF THE DRAWINGS

So that the manner in which the above recited features may be attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Aspects described herein generally relate to an article of manufacture having polishing portions of different material of different material hardness formed therein. In one aspect, an article of manufacture is provided for polishing a substrate is provided, including a polishing article having a polishing surface, the polishing surface including a first polishing portion having a first polishing material for polishing a first portion of the substrate, and a second polishing portion having a second polishing material for polishing a second portion of the substrate.

Embodiments of the article of manufacture may include a round pad of polishing article having the second polishing material concentrically disposed around the first polishing material, the first polishing material concentrically disposed around the second polishing material, or the second polishing material including a center portion and outer portion of the article of manufacture, and the first polishing material forms an annular portion disposed between the center portion and the outer portion. The article of manufacture may also include a web of polishing material with a second polishing material including the outer portion and/or the center portion of polishing article.

Figure 1:
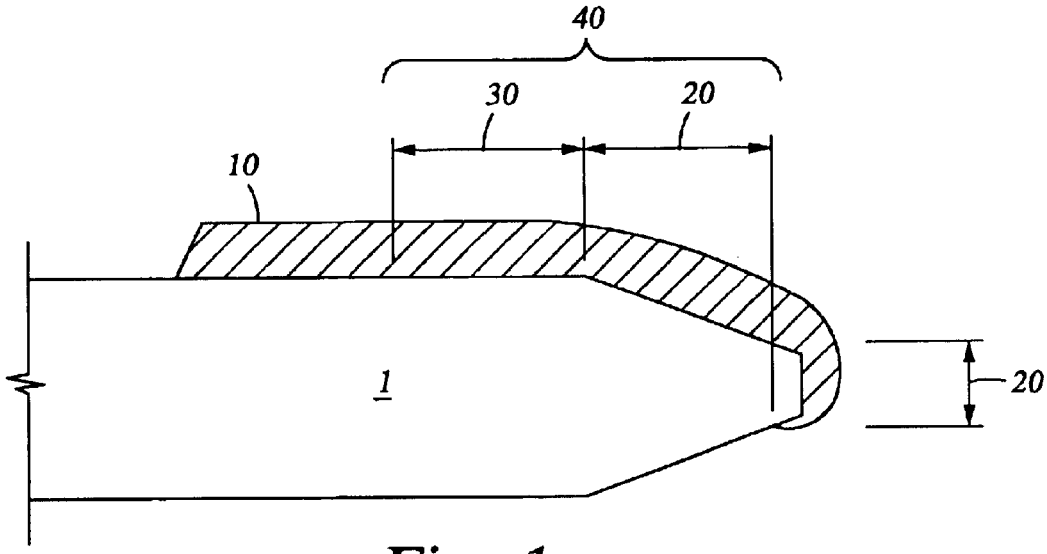
FIG. 1 is a side schematic view of a substrate with material deposited on the edge of the substrate.
Figure 2:
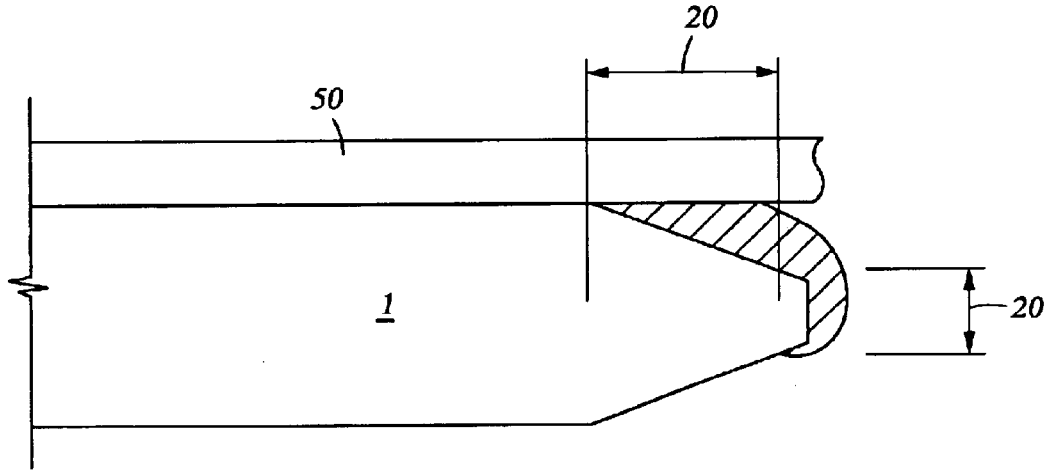
FIG. 2 is a side schematic view of a substrate and a hard polishing pad.
Figure 3:
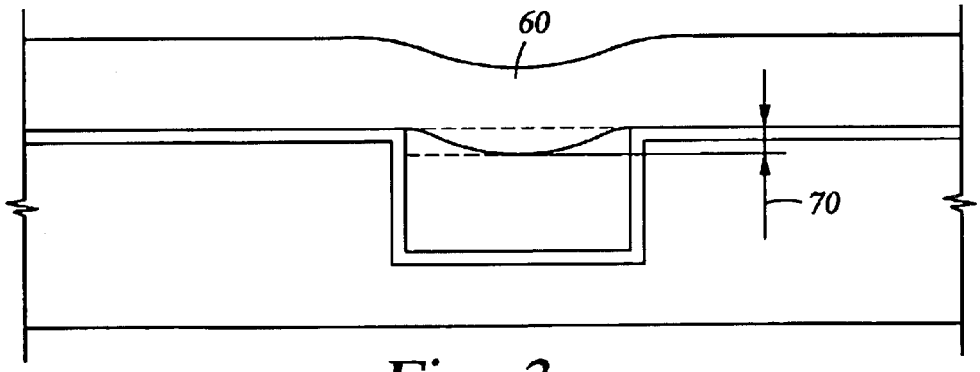
FIG. 3 is a side schematic view of a substrate feature and soft polishing pad.
Figure 4:
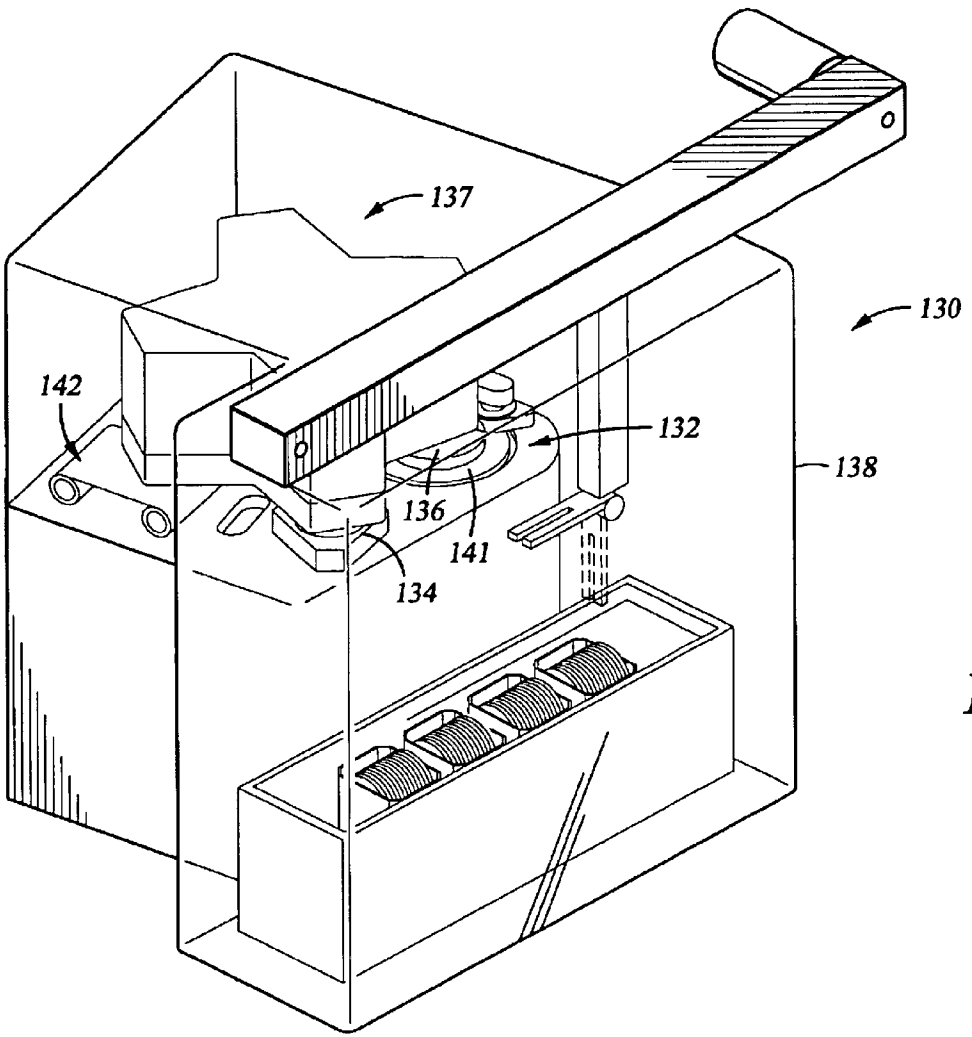
FIG. 4 is a schematic view of a CMP system.

FIG. 4 is a schematic view of a CMP system 130, such as a Mirra® CMP System available from Applied Materials, Inc., located in Santa Clara, Calif. The system shown includes three polishing stations 132 and a loading station 134. Four polishing heads 136 are rotatably mounted to a polishing spindle, or polishing head displacement mechanism 137, disposed above the polishing stations 132 and the loading station 134. A front-end substrate transfer region 138 is disposed adjacent to the CMP system and is considered a part of the CMP system, though the transfer region 138 may be a separate component.

Typically, a substrate is loaded on a polishing head 136 at the loading station 134 and is then rotated through the three polishing stations 132. The polishing stations 132 each comprise a rotating platen 141 having polishing or cleaning pads mounted thereon. The polishing stations 132 may include a platen 141 having a non-rotary surface, e.g., a linear polishing system, using a sliding or circulating polishing belt or similar device, such as platen 142. An example of a linear polishing system is more fully described in co-pending U.S. patent application Ser. No. 09/244,456, filed on Feb. 4, 1999, and incorporated herein by reference to the extent not inconsistent with aspects of the invention described and claimed herein. The platens 141 and 142 may be stationary during polishing or may be rotated during polishing to enhance the polishing process.

One process sequence includes a polishing pad at the first two stations and a cleaning pad at the third station to facilitate substrate surface enhancement, such as buffing or cleaning the substrate surface, at the end of the polishing process in the system 30. Following substrate surface enhancement, the substrate is returned to the front-end substrate transfer region 138 and another substrate is retrieved from the loading station 134 for processing. While the processes described herein relate to being performed on the same processing system, the invention contemplates performing one or more of the process steps described herein on the same polishing station or on multiple polishing systems.

Figure 5:
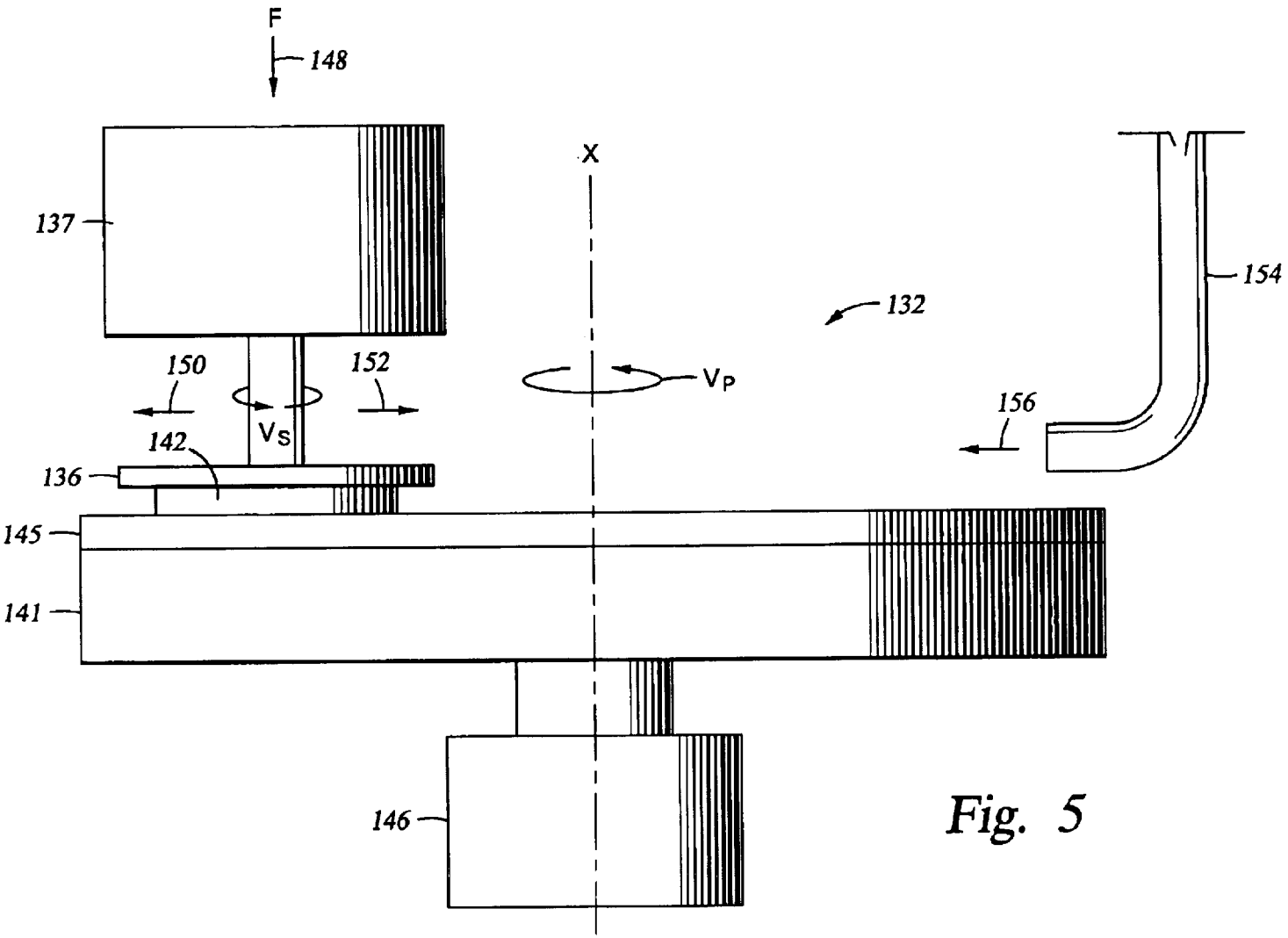
FIG. 5 is a schematic view of a polishing station.

FIG. 5 is a schematic view of a polishing station 132 and polishing head 136 used to advantage with the aspects of the invention described herein. The polishing station 132 comprises a polishing pad assembly 145 secured to an upper surface of a rotatable platen 141. The platen 141 is coupled to a motor 146 or other suitable drive mechanism to impart rotational movement to the platen 141. During operation, the platen 141 is rotated at a velocity $V_p$ about a center axis X. The platen 141 can be rotated in either a clockwise or counterclockwise direction.

FIG. 5 also shows the polishing head 136 mounted above the polishing station 132. The polishing head 136 supports a substrate 142 for polishing. The polishing head 136 may comprise a vacuum-type mechanism to chuck the substrate 142 against the polishing head 136. An example of a suitable polishing head is the Titan Head™ polishing head, manufactured by Applied Materials, Inc., of Santa Clara Calif.

During operation, the vacuum chuck generates a negative vacuum force behind the surface of the substrate 142 to attract and hold the substrate 142. The polishing head 136 typically includes a pocket (not shown) in which the substrate 142 is supported, at least initially, under vacuum. Once the substrate 142 is secured in the pocket and positioned on the pad assembly 145, the vacuum can be removed. The polishing head 136 then applies a controlled pressure behind the substrate, indicated by the arrow 148, to the backside of the substrate 142 urging the substrate 142 against the pad assembly 145 to facilitate polishing of the substrate surface. The polishing head displacement mechanism 137 rotates the polishing head 136 and the substrate 142 at a velocity $V_s$ in a clockwise or counterclockwise direction, preferably the same direction as the platen 141. The polishing head displacement mechanism 137 also preferably moves the polishing head 136 radially across the platen 141 in a direction indicated by arrows 150 and 152.

The CMP system also includes a chemical supply system 154 for introducing a chemical slurry of a desired composition to the polishing pad. The slurry may be an abrasive-free composition or an abrasive-containing composition. The abrasive-containing composition provides an abrasive material, such as solid alumina or silica, which provide additional mechanical abrasion to facilitate the polishing of the substrate surface. During operation, the chemical supply system 154 introduces the slurry, as indicated by arrow 156, on the pad assembly 145 at a selected rate. In other applications the pad assembly 145 may have abrasive particles disposed thereon and require only that a liquid, such as deionized water, be delivered to the polishing surface of the pad assembly 145.

Figure 6A:
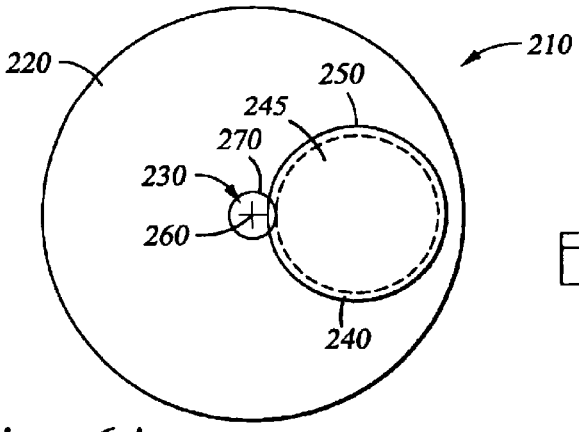
FIG. 6*a* is a schematic top view of one embodiment of a polishing pad.

FIG. 6A is a top view of one embodiment of an article of manufacture, in this aspect, a circular polishing pad of polishing article. The polishing pad 210 includes a first polishing portion 220 of a first polishing material with a second polishing portion 230 of a second polishing material disposed therein. The first polishing portion 220 includes a substrate polishing area of the polishing article and polishes at least the center or field of the substrate surface during a polishing process. The second polishing portion 230 includes an edge substrate polishing area of the polishing article and polishes at least the edge or outer portion of the substrate surface during a polishing process.

The embodiment shown in FIG. 6A includes a polishing pad having a substrate polishing area the size of the center or field of the substrate surface with the edge or outer portion of the substrate contacting the edge substrate polishing area during polishing. The substrate polishing area of the polishing article generally has a width greater than the diameter of a substrate disposed thereon.

Generally, the first polishing material comprises a hard polishing material. A hard polishing material is broadly described herein as a polishing material having a polishing surface of a hardness of about 50 or greater on the Shore D Hardness scale for polymeric materials as described and measured by the American Society for Testing and Materials (ASTM), headquartered in Philadelphia, Pa. The first polishing material may include a polymeric material, i.e., plastic, or foam, such as polyurethane or polyurethane mixed with a filler material. One hard polishing material includes the material comprising the IC-1000 polishing pad from Rodel Inc., of Phoenix Ariz.

The second polishing material may comprise an uniformly compressible material including a polymeric material, i.e., plastic, and/or foam, felt, rubber, or a combination thereof. An example of a second polishing material is polyurethane impregnated with felt. One polishing pad material suitable for the second polishing material comprises the Politex or Suba series, i.e., Suba IV, of polishing pads available from Rodel, Inc. (IC-1000, Politex, and Suba are tradenames of Rodel Inc.)

The second polishing material generally has a hardness less than the first hardness of the first polishing material and is considered a soft material. Soft materials are more flexible and compliant than hard materials when in contact with a substrate 250 during a polishing process. Soft materials have the ability to flex and mold around irregular surfaces such as the bevel edge of a substrate surface. A soft material is broadly described herein as a polishing material having a hardness between about 25 and about 40 on the Shore D Hardness scale for polymeric materials may be used as the second polishing material.

The relative hardness of the first and second polishing materials may also be described in terms of the specific gravity (the ratio of density of the polishing materials to water) of the material. The first polishing material generally has a specific gravity of about 0.6 (0.6 g/cm$^3$ to 1.0 g/cm$^3$ for water) or higher. For example, the first polishing material may include a hard polishing material having a specific gravity between about 0.6 (0.6 g/cm$^3$ to 1.0 g/cm$^3$ for water) and about 0.9 (0.9 g/cm$^3$ to 1.0 g/cm$^3$ for water). The second polishing material generally has a specific gravity less than the specific gravity of the first polishing material. For example, if first polishing material has a specific gravity of about 0.6 (0.6 g/cm$^3$ to 1.0 g/cm$^3$ for water), then the second polishing material has a specific gravity of less than about 0.6 (0.6 g/cm$^3$ to 1.0 g/cm$^3$ for water). The materials used to construct the polishing pad described herein may vary depending on the desired degree of rigidity and compliance desired of the first and second polishing materials.

The second polishing material is disposed in the center or center portion 270 of the polishing pad 210 around the central axis 260 of the polishing pad 210. The second polishing material is disposed adjacent the first polishing material to contact at least a portion of the outer portion 240 and bevel edge and the EBR area of the substrate 250 a portion the time the substrate 250 is in contact with the polishing pad 210 during a polishing process. The second polishing material disposed in the center portion 270 of the polishing pad 210 may have a diameter of between about 0.1 inches and about 0.5 inches for a 200 mm substrate, i.e., generally a sufficient diameter with sufficient flexibility and compliance to contact and polish an edge portion or outer portion 240, including the bevel edge and the EBR area, of the substrate 250 in contact with the polishing pad 210 as shown in FIG. 6A.

As shown in FIG. 6A, both the first and second polishing materials contact the outer portion 240 of the substrate, and the second polishing material provides the necessary flexibility to polish the bevel edge and the EBR area of the substrate 250. The first polishing material polishes the inner portion 255 of the substrate, typically the field of the substrate 250. The dimensions of the polishing portions 220, 230 of the polishing pad 210 may be varied to achieve desired proportions of hard or soft compliant material used to polish desired portions of the substrate surface.

Figure 6B:
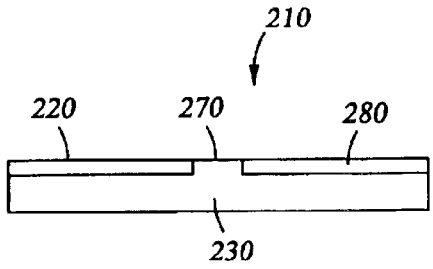
FIG. 6*b* is a schematic side view of the embodiment of the pad in FIG. 6*a;*

FIG. 6B is a schematic cross-sectional view of the polishing pad 210 of FIG. 6A. The polishing pad 210 can be formed by disposing an annular ring 280 of the first polishing material on a polishing pad 230 of the second polishing material. The annular ring 280 generally extends from the center portion 270 of the second polishing material to the perimeter of the polishing pad 210.

Figure 7A:
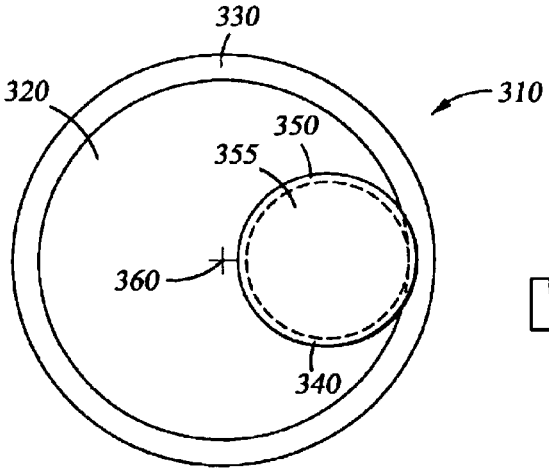
FIG. 7*a* is a schematic top view of another embodiment of a polishing pad.

Referring to FIG. 7A, a top view of another embodiment of an article of manufacture, in this aspect, a circular polishing pad of polishing article. A polishing pad 310 comprises a center polishing portion 320 of a first polishing material, and an outer polishing portion 330 of a second polishing material. The center polishing portion 320 of a first polishing material includes the substrate polishing area and polishes at least the center or field of the substrate surface during a polishing process. The outer polishing portion 330 includes the edge substrate polishing area of the polishing article and polishes at least the edge or outer portion of the substrate surface during a polishing process. The substrate polishing area of the polishing article generally has a width greater than the diameter of a substrate disposed thereon.

The outer polishing portion 330 has a width between about 1 mm (0.3 inches) and about 20 mm (7.9 inches). Generally, the width of the outer polishing portion 330 is sufficient to contact and polish the edge portion or outer portion 340, including the bevel edge and the EBR area, of a substrate 350 in contact with the polishing pad 310 as shown in FIG. 7A. The first polishing material polishes the inner portion 355 of the substrate, which typically includes the field of the substrate 350. The substrate 350 is positioned to contact the second polishing material of the polishing pad 310 at least a portion of the time the substrate 350 is in contact with the polishing pad 310.

Generally, the second polishing material has sufficient flexibility and compliance to polish the outer portion 340, and bevel edge and the EBR area, of the substrate 350 at least a part of the time the substrate 350 is in contact with the polishing pad 310. The first polishing material and second polishing materials are those described above in reference to FIG. 6A. Generally, the first polishing material has a hardness of about 50 or greater on the Shore D Hardness scale for polymeric materials and the second polishing material has a hardness less than the hardness of the first polishing material, for example, a hardness of about 40 or less on the Shore D Hardness scale for polymeric materials.

Figure 7B:
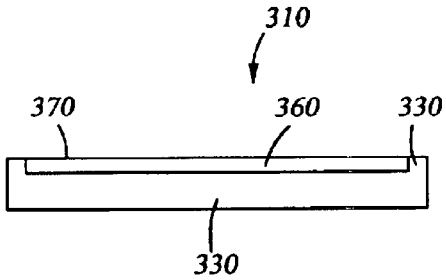
FIG. 7*b* is a schematic side view of the embodiment of the pad in FIG. 7*a;*

FIG. 7B illustrates that the polishing pad 310 shown in FIG. 7A can be formed by disposing a circular portion 370 of a first polishing material on a polishing pad of the second polishing material. The circular portion 370 of first polishing material is disposed around the central axis 360 of the polishing pad 310 and has a diameter less than the diameter of the polishing pad 310 to retain the outer polishing portion 330 of the second polishing material.

Figure 8A:
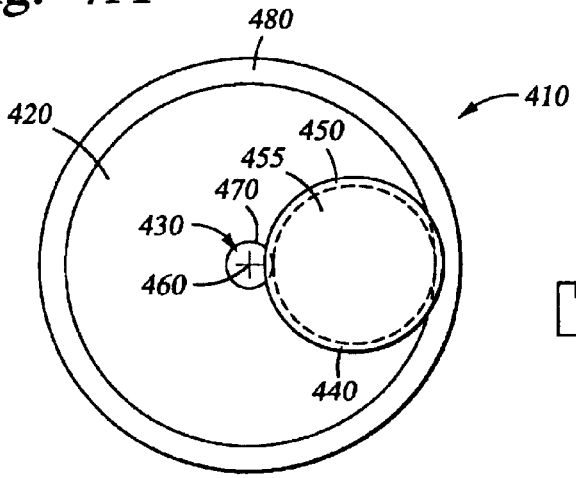
FIG. 8*a* is a schematic top view of another embodiment of a polishing pad.

FIG. 8A is a top view of another embodiment of an article of manufacture, in this aspect, a circular polishing pad of polishing article. The polishing pad 410 includes the first polishing material comprising a substrate polishing area to polish at least the center or field of the substrate surface during a polishing process and the second polishing material comprising the center or center polishing portion 470 of the polishing pad 410 and the outer polishing portion 480 of the polishing pad 410. The center or center polishing portion 470 of the polishing pad 410 and the outer polishing portion 480 of the polishing pad 410 include the edge substrate polishing areas of the polishing article and polishes at least the edge or outer portion of the substrate surface during a polishing process.

The center polishing portion 470 and the outer polishing portion include the first polishing portion of the substrate 450. The center polishing portion 470 of the second polishing material is disposed on and around the central axis 460 of the polishing pad 410. While not shown in FIG. 8A, the substrate polishing area of the polishing article generally has a width greater than the diameter of a substrate disposed thereon.

The center polishing portion 470, for example, may have a diameter of between about 10 mm (3.9 inches) and about 70 mm (28 inches) and the second polishing material of the outer polishing portion 480 has a width between about 1 mm (0.3 inches) and about 20 mm (7.9 inches) for a 200 mm substrate or a sufficient diameter and perimeter width to contact and polish an edge portion or outer portion 440, including the bevel edge and the EBR area, of the substrate 450 in contact with the polishing pad 410 as shown in FIG. 8A. An annular polishing portion 420, or second polishing portion, of a first polishing material is disposed on the polishing pad between the center polishing portion 470 and the outer polishing portion 480.

The first polishing material and second polishing materials are those described above in reference to FIG. 6A. Generally, the first polishing material has a hardness of about 50 or greater on the Shore D Hardness scale for polymeric materials and the second polishing material has a hardness less than the hardness of the first polishing material, for example, a hardness of about 40 or less on the Shore D Hardness scale for polymeric materials.

Generally, the second polishing material has sufficient flexibility and compliance to polish the outer diameter 440, and bevel edge and the EBR area 440, of the substrate 450 with the center polishing portion 470, the outer polishing portion 480, or combinations thereof, for at least a part of the time the substrate 450 is in contact with the polishing pad 410. The first polishing material of the annular polishing portion 420 polishes the inner diameter 455 of the substrate, typically the field of the substrate 450. The dimensions of the first and second polishing portions of the polishing pad 410 including the first and second polishing materials may be varied to achieve desired proportions of hard or soft material used to polish a substrate 450.

Figure 8B:
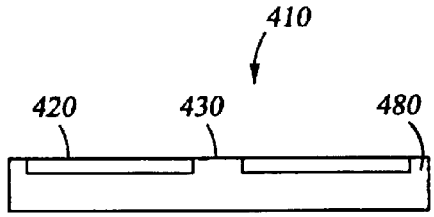
FIG. 8*b* is a schematic side view of the embodiment of the pad in FIG. 8*a;*

FIG. 8B illustrates that the polishing pad 410 shown in FIG. 8A can be formed by disposing an annular ring 420 of a first polishing material on a polishing pad 430 of a second polishing material. The annular ring of the first polishing material is disposed around the center polishing portion 470 of the polishing pad 410 to leave the center portion 470 of the second polishing material 430 and has a diameter less than the diameter of the polishing pad 410 to retain the outer polishing portion 460 of the second polishing material.

Figure 9:
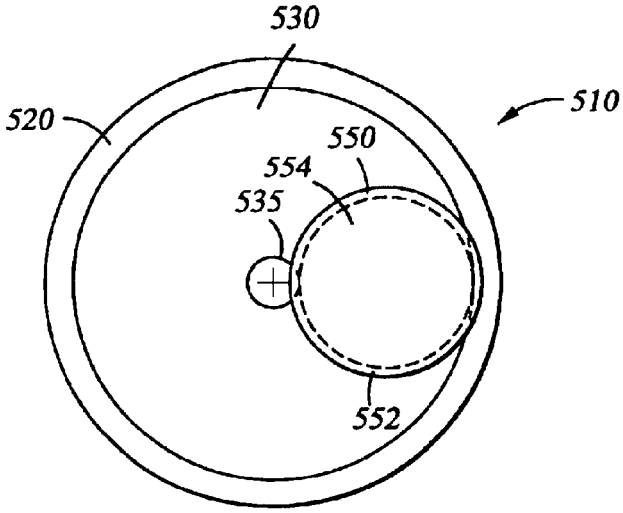
FIG. 9 is a schematic side view of another embodiment of a polishing pad.

In a further aspect of the article of manufacture, the polishing pad 510 may comprise two or more materials having two or more different respective hardness as shown in FIG. 9.

FIG. 9 discloses a polishing pad 510 including a first polishing material 530 with a second polishing material 520 and a third polishing material 535 disposed therein. The first polishing material 530 includes the substrate polishing area and polishes at least the center or field of the substrate surface during a polishing process. The second polishing material 520 and the third polishing material 535 include the perimeter and the center of the polishing article respectively, which may comprise the edge substrate polishing area of the polishing article for polishing at least the edge or outer portion of the substrate surface during a polishing process. While not shown in FIG. 9, the substrate polishing area of the polishing article generally has a width greater than the diameter of a substrate disposed thereon.

The second polishing material 520 generally has a hardness less than the hardness of the first polishing material 530. The third material 535 has a hardness that is greater than, less than or even equal to the first polishing material 530 or the second polishing material 520. For example, the second polishing material may have a hardness less than the first polishing material, and the third material may have a hardness less than the first polishing material, yet have a hardness that is greater than the hardness of the second polishing material. Control of the hardness over the various areas of the polishing pad 510 will allow controllable amounts of flex of the polishing pad and controllable removal of material from the bevel area and EBR area 552 while polishing the inner portion 554 of substrate 550.

By way of further example, the substrate may be of sufficient size as to contact only the first polishing material of the substrate, however, the substrate may be position and repositioned during polishing over the second and/or the third material to polish the bevel edge as desired to the degree desired. Such a polishing technique increases the flexibility of using a polishing pad with multiple hardnesses to achieve sufficient polishing control.

While, the above description pertains to polishing substrate on round polishing pad disposed on rotatable platens, the invention contemplates using aspects of the invention described herein with other types of polishing article, for example, a linear web of polishing article. While the above description herein describes the use of the IC series of pads from Rodel Inc., as hard materials, the invention is equally applicable to all polishing article having the hardness described herein or are conventionally described as hard media by those skilled in the art. Further, the invention contemplates that the polishing pads described herein may be further physically modified, such as the polishing pads that include grooves, perforations, variable perforation sizes and numbers, compressibility and abrasiveness, to improve polishing on various apparatus, for various processes, and polishing of different substrate materials.

Figure 10:
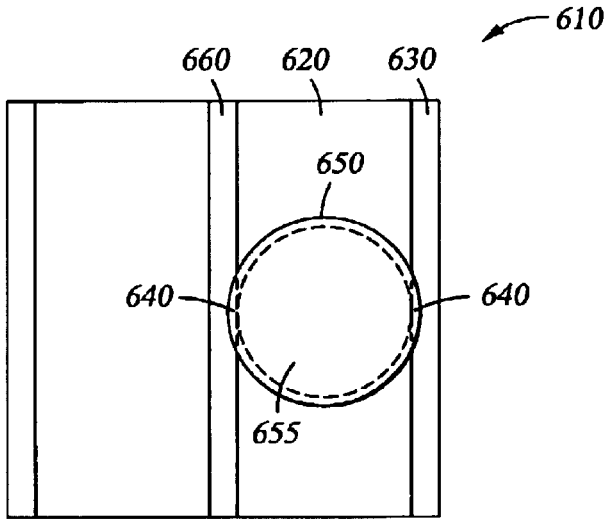
FIG. 10 is a schematic top view of one embodiment of a linear polishing article.

FIG. 10 is a top schematic view of one embodiment of a linear web of polishing article. The polishing article 610 includes the second polishing material forming a center portion 660 of the polishing article 610 and the outer portion or perimeter 630 of the polishing article 610. The polishing portion 620 includes the substrate polishing area and polishes at least the center or field of the substrate surface during a polishing process. The center polishing portion 660 and outer polishing portion 630 include the edge substrate polishing area of the polishing article and polishes at least the edge or outer portion of the substrate surface during a polishing process. While not shown in FIG. 10 the substrate polishing area of the polishing article may have a width smaller, the same, or greater than the diameter of a substrate disposed thereon.

Referring to FIG. 10, the polishing article 610 has a center portion 660 sufficient width and a perimeter 630 of a sufficient width to contact and polish an edge portion or outer portion 640, including the bevel edge, of the substrate 650 in contact with the polishing article 610 with the inner portion 655 polished with the first polishing material 620 of the substrate.

Alternatively, only the center portion 660 or the perimeter 630 polishes the outer portion 640 of the substrate 650. An example of a linear polishing system suitable for polishing with the polishing article 610 is more fully described in copending U.S. patent application Ser. No. 09/244,456, filed on Feb. 4, 1999, and incorporated herein by reference to the extent not inconsistent with aspects of the invention described and claimed herein.

Figure 11:
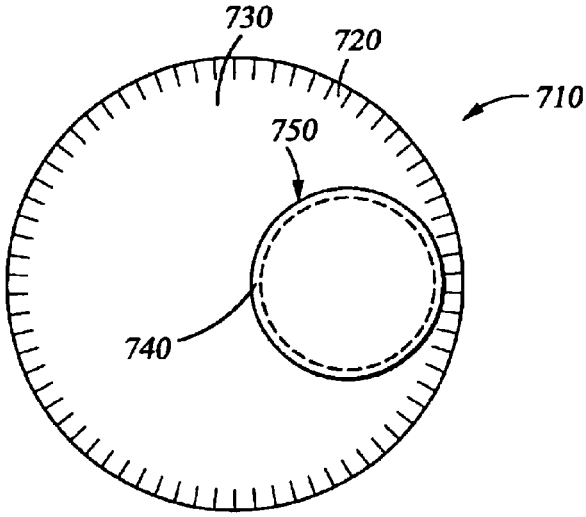
FIG. 11 is a schematic top view of another embodiment of a polishing pad.

FIG. 11 is another embodiment of an article of manufacture, in this aspect, a circular polishing pad of polishing article. The polishing pad 710 includes an area of modified mechanical properties, such as improved flexibility of the polishing article surface, in the outer polishing portion 720 of the material 730 including the polishing article. The outer polishing portion 720 includes the edge substrate polishing area of the polishing article and polishes at least the edge or outer portion of the substrate surface during a polishing process while the remaining portion of the polishing pad 710 includes the substrate polishing area and polishes at least the center or field of the substrate surface during a polishing process. While not shown in FIG. 11, the substrate polishing area of the polishing article generally has a width greater than the diameter of a substrate disposed thereon.

The mechanical properties may be modified by a mechanical change in the condition of the polishing article, for example, by a perforated area or area with a plurality of incisions in the outer polishing portion 720 of a first polishing material 730.

The incisions can be made in the polishing article from a depth of about 0.1 millimeter to an incision completely through the polishing article. The incisions are generally made at about a width of about 1 millimeters or less, and between about 5 millimeters and about 20 millimeters in length from the edge of the polishing article. The length, width, or depth of the incision may vary depending upon the requirements of the user to provide a sufficient diameter and perimeter width to contact and polish an edge portion or outer portion 740, including the bevel edge and the EBR area, of the substrate 750 in contact with the polishing article 710 as shown in FIG. 11. The width, depth, and number of incisions may vary upon the design characteristics of the desired process to be performed.

The change in mechanical properties, such as by the plurality of incisions, provide localized flexibility to the outer polishing portion 720 to reduce the hardness of the first polishing material to a second hardness less than the first hardness. For example the polishing material of the polishing pad 710 may be a hardness of about 50 or greater on the Shore D Hardness scale for polymeric materials, but is modified to exhibit a hardness of about 40 or less on the Shore D Hardness scale for polymeric materials.

Reduction in the hardness of the first polishing material by mechanical means allows the outer polishing portion 720 to polish the edge portion 740, including the bevel edge area, of a substrate 750 polished thereon. The outer polishing area thus performs analogously to a second polishing material having a second hardness in the aspects described above. While the use of incisions is provided as one example of the modification of the mechanical properties to improve the flexibility of the outer polishing portion 720 of the polishing article 710, the invention contemplates modification of other properties by mechanical or chemical methods during fabrication of the polishing article, such as exposure to chemicals or ultraviolet light during fabrication, or modification of materials following fabrication, such as by perforating the outer portion of the polishing article.

It is believed that when a substrate is processed with the polishing pads described herein, a definite pressure is applied to the pad of polishing article, whereby the resulting pressure causes the second polishing material to flex and contact the bevel edge to polish material deposited of the substrate, such as copper and tungsten, while the field of the substrate is polished by the first polishing material. The polish of the substrate field and substrate edge is believed to produce improved substrate surface uniformity with reduced or minimal particle generation, which reduces cross-contamination with the polishing apparatus and provides improved substrate to substrate polishing uniformity.

In operation, the polishing article is disposed on the platen 142 of the polishing station 132. A substrate 142 on the polishing head is contacted with the polishing article disposed in the electrolyte and contacted with the polishing article 145. Polishing compositions, such as a polishing slurry is flowed between the substrate 142 and the polishing article 145. The substrate 142 and the polishing article 145 are contacted and a relative motion is established between the substrate 142 and the polishing article 145. The substrate 142 and the polishing article 145 are rotated relative to one another to polish the substrate surface at between 30 and 300 rpms, and a contact pressure of about 6 psi or less to the substrate surface.

The center or field of the substrate is polished in the substrate polishing area of the polishing article 145. The relative motion of the substrate 142 and the polishing article 145 provide sufficient movement along the substrate polishing area to have a portion of the substrate, typically the edge of the substrate, contact the edge substrate polishing area. Generally only a portion of the edge of the substrate is contacted with the edge substrate polishing area. Material disposed on the edge bead removal area is removed by the polishing materials of the substrate polishing area and the edge substrate polishing area to planarize the substrate surface. The flexible polishing material of the edge substrate polishing area is believed to conform the shape of the bevel edge of the substrate and remove material from the bevel edge by the polishing motion between the substrate 142 and the polishing article 145.

While the above described hardness is described to a hardness rating on the Shore D Hardness scale for polymeric materials, the hardness, or flexibility, of polishing materials may be defined by the material's respective hydrostatic moduli. The hydrostatic modulus measures the resistance to change in the volume without changes in the shape under a hydrostatic pressure P. The hydrostatic modulus K equals (Pv)/( )v), where P is the hydrostatic pressure applied to a layer (assuming that the layer is initially under no pressure), and (v)/( )v) is the volumetric strain.

In one aspect of the invention, when the second polishing material has a second hardness less than the first hardness, the second polishing material may have a low hydrostatic modulus relative to the first polishing material. Thus, for example, the hydrostatic modulus of the second polishing material is less than about 400 psi per psi of compressive pressure when a pressure between the substrate surface and the polishing pad is applied in the range between about 2 psi and about 20 psi. The hydrostatic modulus of the first polishing material is greater than about 400 psi per psi of compressive pressure when a pressure between the substrate surface and the polishing pad is applied in the range between about 2 psi and about 20 psi.

The low hydrostatic modulus of the second polishing material permits the second polishing material to elastically deform while the high hydrostatic modulus of the first polishing material promotes a degree of bridging across high points on a substrate to planarize the same. Thus, the cooperation of the first polishing material and the second polishing material achieves planarization of the substrate and removal of material from the bevel edge of the substrate on a single multi-phase pad.

While foregoing is directed to the preferred embodiment of the invention, other and further embodiments of the invention may be devised without departing from the basic scope thereof, and the scope thereof is determined by the claims that follow.

What is claimed is:

1. An article of manufacture for polishing a substrate, comprising:

a polishing article having a polishing surface, the polishing surface comprising:

a first polishing portion having a first polishing material of a first hardness adapted to polish a center portion of the substrate; and a second polishing portion having a second polishing material of a second hardness adapted to polish an outer portion of the substrate, wherein the first hardness is greater than the second hardness and the first hardness is about 50 or higher on a Shore D hardness scale.

2. An apparatus for processing a substrate, comprising:

a rotatable, stationary, or linear platen; and a polishing article having a polishing surface, the polishing surface comprising a first polishing portion having a first polishing material of a first hardness adapted to polish a center portion of the substrate; and a second polishing portion having a second polishing material of a second hardness adapted to polish an outer portion of the substrate, wherein the first hardness is greater than the second hardness and the first hardness is about 50 or higher on a Shore D hardness scale.

3. A method for processing a substrate, comprising:

providing a rotatable platen and polishing article disposed thereon, the polishing article having a polishing surface comprising a first polishing portion having a first polishing material of a first hardness adapted to polish a center portion of the substrate and a second polishing portion having a second polishing material of a second hardness adapted to polish an outer portion of the substrate, wherein the first hardness is greater than the second hardness; and contacting the substrate on the polishing article, the center portion of the substrate contacting the first polishing material and the outer portion of the substrate contacting the second polishing material and the first hardness is about 50 or higher on a Shore D hardness scale.

4. An article of manufacture for polishing a substrate, comprising:

a polishing article having a polishing surface, the polishing surface comprising:

a first polishing portion having a first polishing material of a first hardness adapted to polish a center portion of the substrate; and a second polishing portion having a second polishing material of a second hardness adapted to polish an outer portion of the substrate, wherein the first hardness is greater than the second hardness and the first polishing material has a specific gravity of about 0.6 or greater.

5. An apparatus for processing a substrate, comprising:

a rotatable, stationary, or linear platen; and a polishing article having a polishing surface, the polishing surface comprising a first polishing portion having a first polishing material of a first hardness adapted to polish a center portion of the substrate; and a second polishing portion having a second polishing material of a second hardness adapted to polish an outer portion of the substrate, wherein the first hardness is greater than the second hardness and the first polishing material has a specific gravity of about 0.6 or greater.

6. A method for processing a substrate, comprising:

providing a rotatable platen and polishing article disposed thereon, the polishing article having a polishing surface comprising a first polishing portion having a first polishing material of a first hardness adapted to polish a center portion of the substrate and a second polishing portion having a second polishing material of a second hardness adapted to polish an outer portion of the substrate, wherein the first hardness is greater than the second hardness; and contacting the substrate on the polishing article, the center portion of the substrate contacting the first polishing material and the outer portion of the substrate contacting the second polishing material, wherein the first polishing material has a specific gravity of about 0.6 or greater.

* * * * *